United States Patent [19]

Mandotti

[11] Patent Number: 5,076,750

[45] Date of Patent: Dec. 31, 1991

[54] APPARATUS FOR AUTOMATICALLY LOADING AND UNLOADING ADHESIVE TAPE CORES ON ADHESIVE TAPE ROLL MAKING MACHINES

[76] Inventor: Gianbattista Mandotti, Via Como, 12.4, 20020 Lainte, Milan, Italy

[21] Appl. No.: 530,817

[22] Filed: May 30, 1990

[30] Foreign Application Priority Data

Nov. 3, 1989 [IT] Italy ..... 22264 A/89

[51] Int. Cl.[5] ..... B65G 47/04

[52] U.S. Cl. ..... 414/222; 414/911

[58] Field of Search ..... 414/222, 225, 331, 332, 414/728, 731, 738, 746.8, 911

[56] References Cited

U.S. PATENT DOCUMENTS

| | | | |
|---|---|---|---|
| 3,543,910 | 12/1970 | Devol et al. | 414/728 |
| 3,620,380 | 11/1971 | Borodin | 414/728 |
| 4,077,245 | 3/1978 | Bauer et al. | 414/222 X |
| 4,369,872 | 1/1983 | Sticht | 414/225 X |
| 4,626,160 | 12/1986 | Shiomi et al. | 414/222 |
| 4,655,141 | 4/1987 | Gillson | 414/746.8 X |
| 4,800,640 | 1/1989 | Miyazaki et al. | 414/222 X |
| 4,988,252 | 1/1991 | Yamamoto et al. | 414/225 X |

FOREIGN PATENT DOCUMENTS

| | | | |
|---|---|---|---|
| 0174004 | 8/1986 | Japan | 414/911 |

*Primary Examiner*—David A. Bucci
*Assistant Examiner*—James Keenan
*Attorney, Agent, or Firm*—Bucknam and Archer

[57] ABSTRACT

An apparatus for automatically loading and unloading adhesive tape cores on adhesive tape roll making machines comprises a bearing structure provided with sliding horizontal guides thereon corresponding trolleys are slidably driven, which support comb elements adapted to respectively transfer adhesive tape cores from a magazine to a cutting and rewinding machine and formed adhesive tape rolls from this machine to an adhesive roll ejecting device, the bearing structure being moreover provided with movable fork arms which are driven to transfer mandrel element supporting cores to the adhesive tape making machine and remove from this machine mandrel elements thereon formed adhesive tape rolls are arranged.

3 Claims, 4 Drawing Sheets

APPARATUS FOR AUTOMATICALLY LOADING AND UNLOADING ADHESIVE TAPE CORES ON ADHESIVE TAPE ROLL MAKING MACHINES

BACKGROUND OF THE INVENTION

The present invention relates to an apparatus for automatically loading and unloading adhesive tape cores on adhesive tape roll making machines.

As is known, adhesive tape rolls are usually made by using suitable rewinding-cutting machines which are supplied with rolled adhesive sheet material and are adapted to cut the adhesive sheet material by multiple blades and rewind the cut individual adhesive strips to form individual adhesive strip or tape rolls.

Also known is the fact that the mentioned machines are so designed as to wind the individual adhesive strips or tapes on corresponding core elements, i.e. tubular supporting elements, made of cardboard, plastic materials or the like, which cores must be preliminarily mounted on core supporting mandrels which are rotatively driven by turning means included in these machines.

In the mentioned known adhesive roll making machines, however, the core supporting mandrel is usually manually handled for removal purposes and for replacing it by an empty-core bearing mandrel.

Thus, for carrying out the above mentioned loading and unloading manual operations there are required one or more operators which negatively affects the operative yield as well as the cost of the finished products.

SUMMARY OF THE INVENTION

Accordingly, the main object of the present invention is to overcome the above mentioned drawbacks, by providing an apparatus for automatically loading and unloading adhesive tape cores on adhesive tape roll making machines which is specifically adapted to automatize all of the operations associated with the loading and unloading of the adhesive tape cores.

Another object of the present invention is to provide such an apparatus which is adapted to operate in a very reliable way and which, moreover, can be easily fitted to the existing adhesive tape ro11 making machines.

Yet another object of the present invention is to provide such an apparatus which can be easily made starting from easily available elements and materials.

According to one aspect of the present invention, the above mentioned objects, as well as yet other objects, which will become more apparent hereinafter, are achieved by an apparatus for automatically loading and unloading adhesive tape cores on adhesive tape roll making machines, wherein said apparatus essentially comprises a bearing structure provided with sliding horizontal guides for slidably receiving thereon corresponding trolleys supporting comb elements adapted to transfer adhesive tape cores from a core magazine to an adhesive tape cutting and winding machine and to transfer formed adhesive tape rolls from said cutting and winding machine to an ejecting device, said structure further comprising movable fork arms adapted to transfer mandrel members supporting empty cores to said machine and remove from said machine adhesive tape roll-core assemblies.

BRIEF DESCRIPTION OF THE DRAWINGS

Further characteristics and advantages of the apparatus for automatically loading and unloading adhesive tape cores on adhesive tape roll making machines according to the invention, will become more apparent from the following detailed disclosure of a preferred embodiment thereof which is illustrated, by way of an indicative but not limitative example, in the figures of the accompanying drawings, where.

DESCRIPTION OF THE PREFERRED EMBODIMENT

Figure 1:
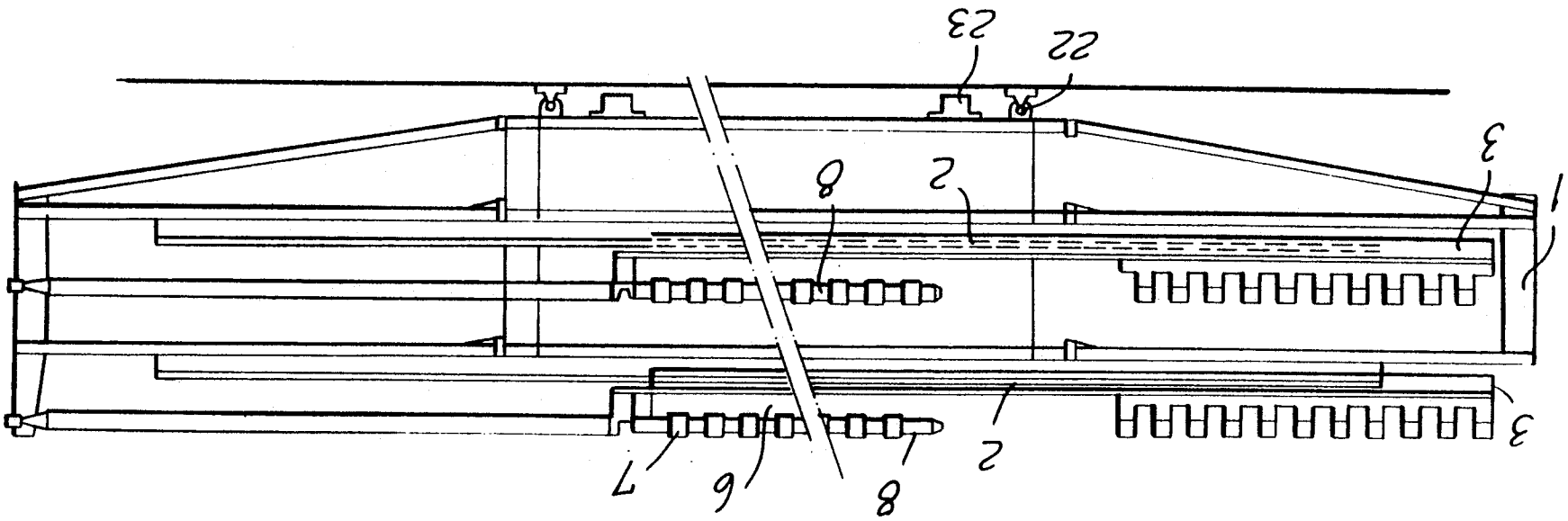
FIG. 1 is a schematic elevation view of the apparatus according to the present invention.

With reference to the figures of the accompanying drawings, the apparatus for automatically loading and unloading adhesive tape cores on adhesive tape roll making machines according to the invention essentially comprises a bearing structure 1 comprising an elongated bearing frame thereon there are arranged, in a superimposed relationship, horizontal sliding guides 2.

With these guides there are engage corresponding trolleys 3 which are driven by rotary screw elements 4 in turn engaging in corrsponding nut screws.

More specifically, the trolleys 3 are driven along the horizontal sliding guides 2 in a known manner by means of the rotary screws 4 which are parallel to the guides 2 and each of which engages with a nut screw defined in a small block rigid with a respective trolley 3. In this connection it should be apparent that the nut screw block might have a length smaller than that of the related trolley. Such a screw-nut screw drive is well known in the mechanical field and is broadly used for example in machine tools for driving an operating tool in a parallel relationship with respect to the axis of a mandrel supporting a work piece to be machined.

On the mentioned trolleys there are sequentially mounted two comb elements 5 and 6 which are adapted to respectively restrain cores 7 to be arranged on mandrels 8 and formed adhesive tape rolls 9 to be unloaded.

With the core supporting comb element, in particular, a tilting cover element 10 cooperates, adapted to restrain said cores, said tilting cover being driven for performing opening and closing displacements by a double-acting cylinder 11.

Figure 2:
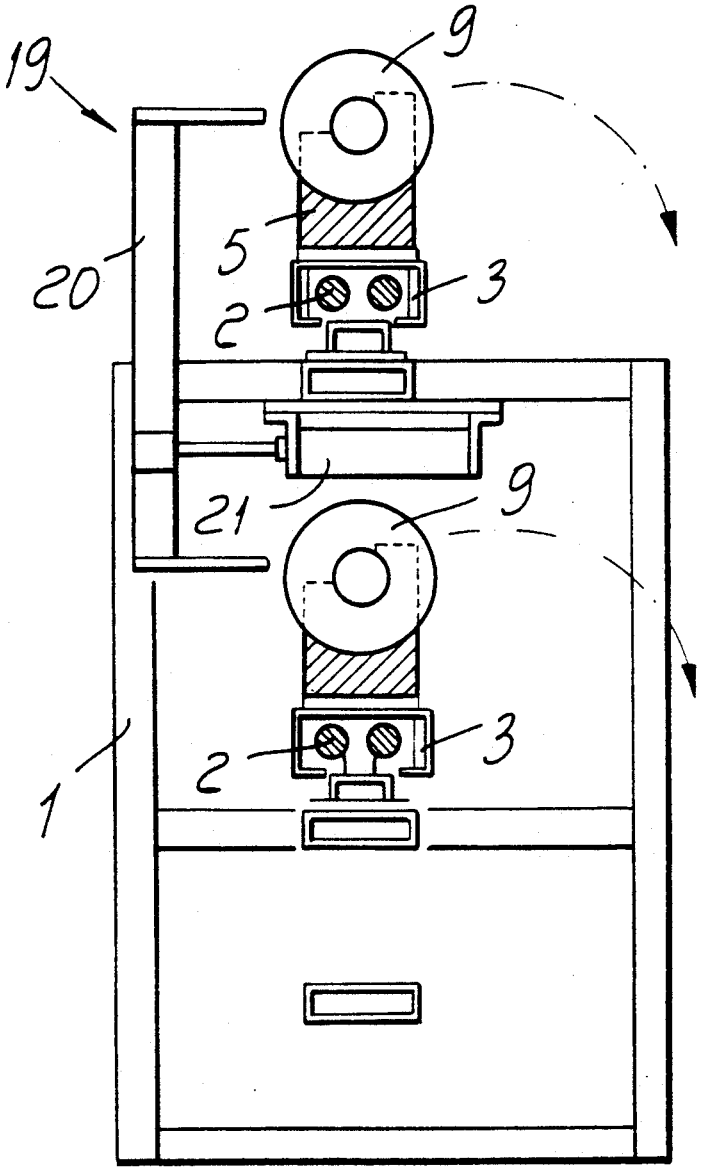
FIGS. 2, 3 and 4 show corresponding cross-sectional views of the apparatus according to the invention respectively related to the formed adhesive tape roll unloading region, the winding machine mandrel loading and unloading regions and to the core loading region.
Figure 3:
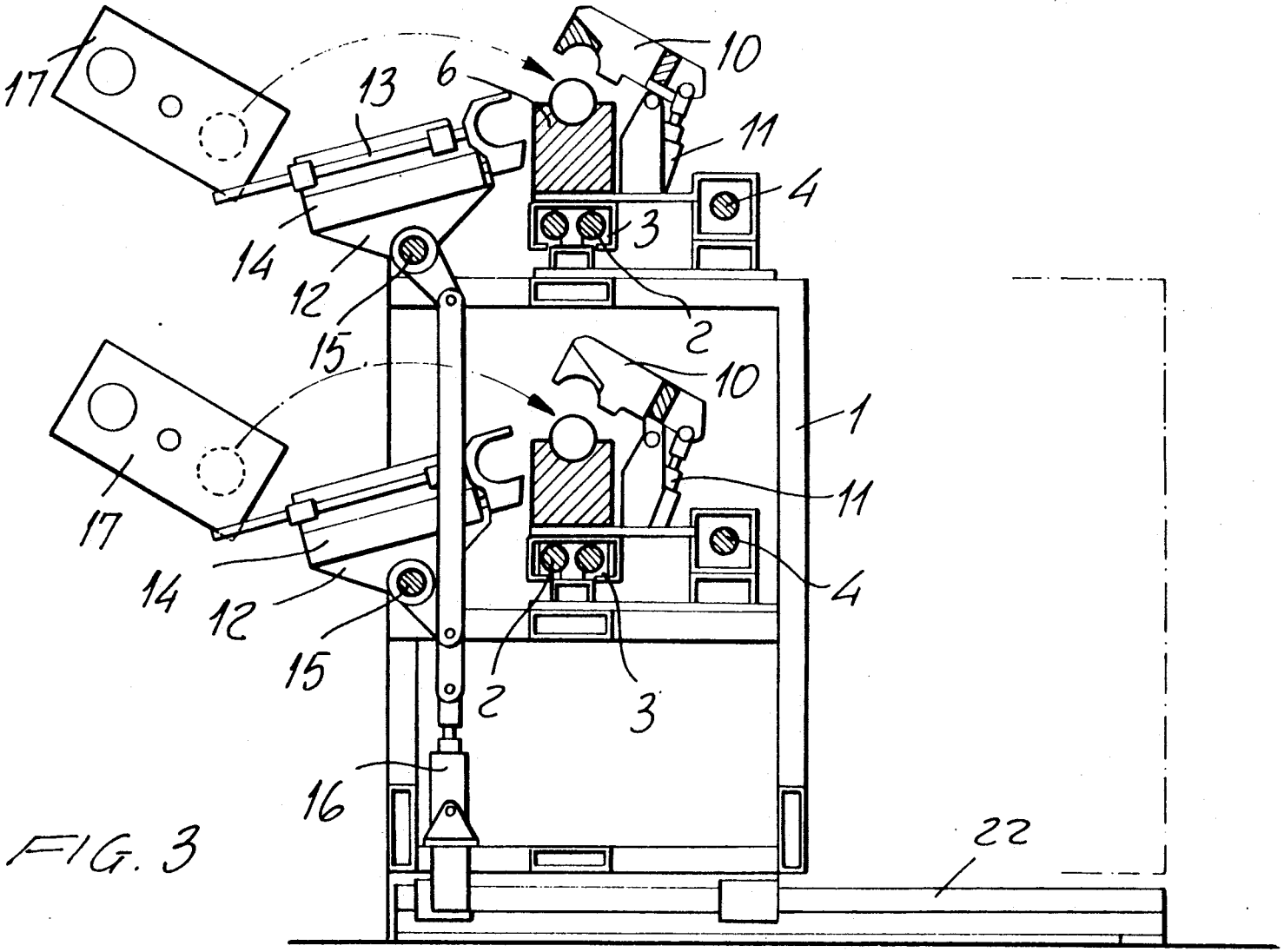
Figure 4:
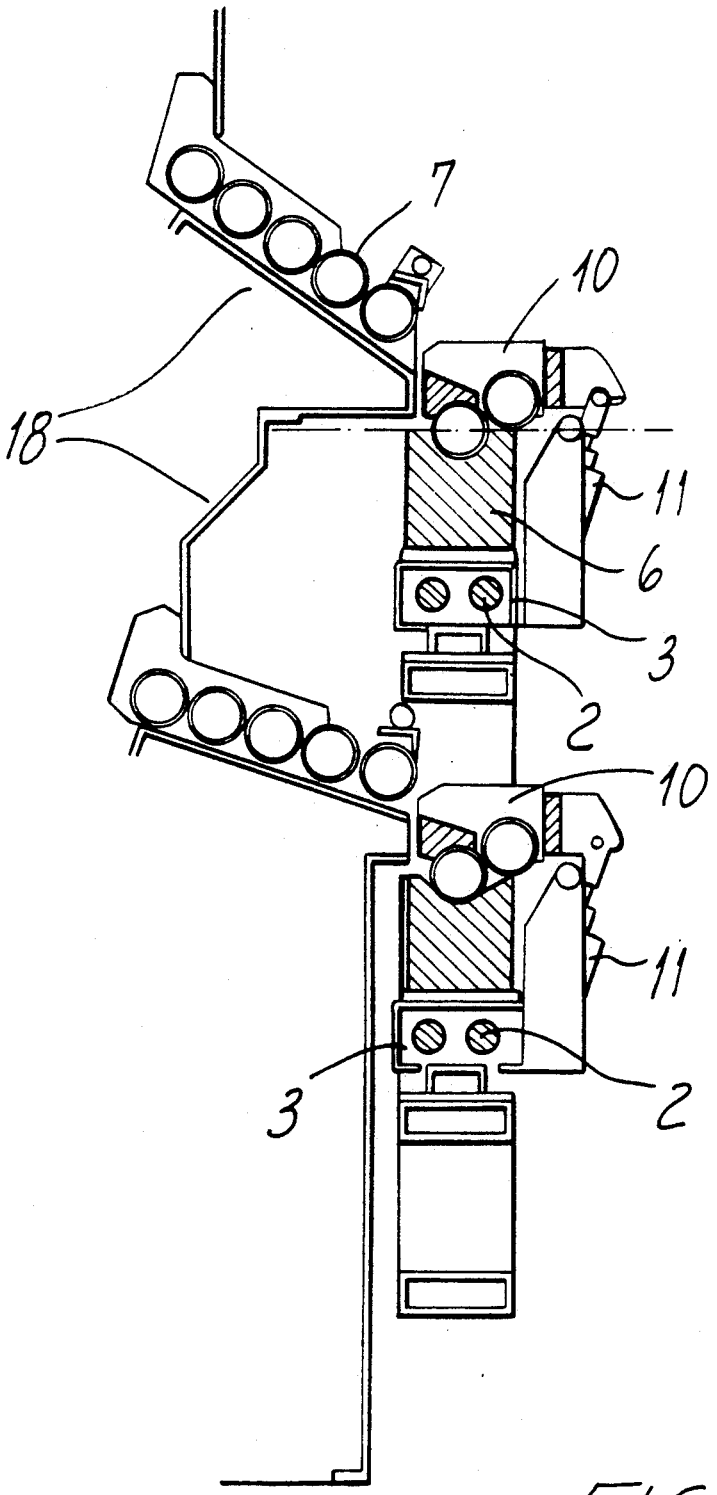

The cover 10 is mounted on the trolley 3 of the comb element 6 and is driven with the latter along the guides 2. In this connection it should be apparent that the cover element 10 is supported near the end portions of the trolley 3. In FIG. 3, in particular, a portion of the support of the cover element 10 is masked by the provision of the arm which rigidly connects the mentioned block with the nut screw and the trolley. As mentioned, said block does not extend for the overall length of the trolley. The cross-sectional view of FIG. 3 has been taken through an intermediate region of the trolley and, accordingly, it also shows the mentioned block coupled to the screw 4, whereas FIG. 4 shows a cross-sectional view taken through an end region of the trolley, which region is not interested by the mentioned block. The same thing is also valid for FIG. 2, which, on the other hand, relates to the trolley supporting the comb 5.

On the structure 1 there are moreover pivotably mounted support elements 12 which bear fork arms 13 adapted to be driven by corresponding cylinders 14.

These support elements, in turn, can rotate about a pivot axis 15 by means of another double acting cylinder 16.

The mentioned fork arms are so arranged and designed, as it is schematically shown in FIG. 3, as to load the mandresls thereon there are arranged empty cores, on a revolver device 17 adhesive tape winding machine and unload from said device the mandrels supporting the formed adhesive tape rolls.

As will be disclosed in more detail hereinafter, the fork arms 13 will transfer a mandrel and its related cores from the comb 6 to the revolver device 17 and then, after having driven the combs 5 and 6 along the horizontal guides 2 and having caused the comb 5 to assume the position previously occupied by the comb 6, said fork arms will transfer a mandrel loaded by adhesive tape rolls from the revolver device to the comb 5.

FIG. 3 shows a mandrel with a single "circle" since the cross-section has been taken through a region of this mandrel which is not interested by the cores which latter, on the other hand, have been shown in FIG. 4 by two concentric circles.

In this connection it should be pointed out that upstream of the winding machine there is arranged a core magazine 18 whereas, downstream of said machine, there is arranged a formed adhesive tape roll unloading device, indicated generally at the reference number 19.

More specifically, this unloading device comprises an ejecting frame element 20 adapted to be driven with a paralled relationship to itself by means of a further double acting cylinder 21.

During the operation of the apparatus, as the core bearing comb element is arranged near the magazine 18, the formed adhesive tape roll bearing comb element will be arranged near the device 17 of the winding machine.

In this condition, the core supporting comb element, with the cover in a closed condition, will support in the gaps thereof provided between adjoining tooth members, corresponding cores, whereas the adhesive tape roll supporting comb element will receive, through its related fork arm, the adhesive tape roll-core assemblies.

In this connection it should apparent that the mandrel 8, with the adhesive tape rolls, will be arranged on the comb 5 which, as it is driven along the horizontal guides 2, will cause the adhesive tape rolls to be removed from the mandrel 8 which is not driven along the horizontal guide 2. Thus, exclusively the adhesive tape rolls will be sent to the unloading device 19. Simultaneously, the comb 6 will be driven along the horizontal guides 2 and will arrange on the same mandrel 8 new cores which have been previously loaded on the comb 6 from the magazine 18. Then, this mandrel will be brought by the fork arms 13 onto the revolver device 17 and the comb 6 will return into the magazine 18, whereas the comb 5 will be driven near the fork arms 13 in order to receive another mandrel loaded with adhesive tape rolls.

Then, the trolleys 3 will be driven along the guides 2 so as to allow adhesive tape rolls to be removed from the mandrels 8 and carried to the unloading device 19, whereas new empty cores will be loaded again on said mandrels.

Then, the frame element 20 will eject the adhesive tape rolls from the combs 5 and the fork arms 13 will arrange the mandrel supporting the empty cores on the revolver device of the machine.

In this connection it should be apparent that the disclosed magazines will be so designed and arranged as to automatically release empty cores into the mentioned intertooth gaps.

The combs, furthermore, must be easily interexchangeable so as to fit different length empty cores.

In particular, the disclosed core handling system will afford the possiblity of easily handling both 1"-cores and 3"-cores.

Another advantage of the disclosed apparatus is that the supporting structure is advantageously mounted on sliding guides 22 along which it can be driven by suitable driven cylinders 23.

From the above disclosure and from the figures of the accompanying drawings, it should be apparent that the invention fully achieves the intended objects.

While the invention has been dislcosed and illustrated with reference to a preferred embodiment thereof, it should be apparent that the disclosed embodiment is susceptible to several modifications and variations all of which will come within the spirit and scope of the appended claims.

We claim:

1. An apparatus for automatically loading and unloading adhesive tape cores on adhesive tape roll making machines, comprising a bearing structure provided with sliding horizontal guides for slidably receiving thereon corresponding trolleys, comb elements adapted to transfer adhesive tape cores from a core magazine to an adhesive tape cutting and winding machine and to transfer formed adhesive tape rolls from said cutting and winding machine to an ejecting device, said bearing structure further including movable fork arms adapted to transfer mandrel members supporting empty cores to said machine and remove from said machine adhesive tape roll-core assemblies, said horizontal sliding guides supporting said trolleys, rotary screw elements being moreover provided for driving said trolleys, wherein said trolleys sequentially support two comb elements respectively adapted to restrain empty cores to be arranged on mandrels and formed adhesive tape rolls to be unloaded, the empty core bearing comb element cooperating with a tilting cover element restraining said empty cores, a first double acting cylinder being provided for opening and closing said cover.

2. An apparatus according to claim 1, wherein said structure pivotally supports supporting elements bearing fork arms adapted to be driven by driving cylinders, said supporting elements being rotatively driven by a second double acting cylinder.

3. An apparatus according to claim 1, wherein said apparatus comprises, upstream of said winding machine, an empty core magazine and, downstream of said machine, a formed adhesive tape roll unloading device, said unloading device comprising an injecting frame element which is driven by a third double acting cylinder, said magazine being so designed and arranged as to automatically release empty cores into gaps of said core being comb element.

* * * * *